United States Patent [19]

DeSelms et al.

[11] Patent Number: 4,782,012

[45] Date of Patent: Nov. 1, 1988

[54] PHOTOGRAPHIC MATERIAL CONTAINING A NOVEL DIR-COMPOUND

[75] Inventors: Roy C. DeSelms; Jon A. Kapecki, both of Rochester, N.Y.

[73] Assignee: Eastman Kodak Company, Rochester, N.Y.

[21] Appl. No.: 74,582

[22] Filed: Jul. 17, 1987

[51] Int. Cl.[4] ..... G03C 1/06; G03C 7/16; G03C 7/26; G03C 7/32

[52] U.S. Cl. ..... 430/544; 430/223; 430/381; 430/382; 430/548; 430/558; 430/611; 430/613; 430/957

[58] Field of Search ..... 430/381, 548, 382, 957, 430/223, 544, 558, 611, 613

[56] References Cited

U.S. PATENT DOCUMENTS

| | | | |
|---|---|---|---|
| 3,379,529 | 4/1968 | Porter et al. | 430/544 |
| 3,733,201 | 5/1973 | Barr et al. | 430/385 |
| 4,248,962 | 2/1981 | Lau | 430/385 |
| 4,409,323 | 10/1983 | Sato et al. | 430/550 |
| 4,612,278 | 9/1986 | Lau et al. | 430/381 |
| 4,652,516 | 3/1987 | Ichijima et al. | 430/544 |
| 4,678,735 | 7/1987 | Kitaguchi et al. | 430/203 |
| 4,678,739 | 7/1987 | Kitaguchi et al. | 430/353 |
| 4,684,604 | 8/1987 | Harder | 430/375 |
| 4,686,175 | 8/1987 | Ogawa et al. | 430/957 |

FOREIGN PATENT DOCUMENTS

| | | |
|---|---|---|
| 0228561 | 7/1987 | European Pat. Off. . |
| 205150 | 11/1983 | Japan . |
| 236551 | 10/1986 | Japan . |
| 2099167 | 12/1982 | United Kingdom . |

*Primary Examiner*—Mukund J. Shah

*Attorney, Agent, or Firm*—Joshua G. Levitt

[57] ABSTRACT

Photographic elements and processes are described which employ compounds capable of releasing, as a function of silver halide development, a deactivatable development inhibitor to provide a combination of desirable sensitometric results. The deactivatable development inhibitor has the structure:

wherein

X is alkylene of 1 to 3 carbon atoms;

R is alkyl of 1 to 4 carbon atoms; and the sum of the carbon atoms in X and R is 5 or less.

11 Claims, No Drawings

PHOTOGRAPHIC MATERIAL CONTAINING A NOVEL DIR-COMPOUND

FIELD OF THE INVENTION

This invention relates to photographic compounds, such as couplers, which release a deactivatable development inhibitor moiety during processing and to materials and processes using such compounds.

DESCRIPTION OF THE STATE OF THE ART

Images are commonly obtained in the photographic art by a coupling reaction between the development product of a silver halide color developing agent (i.e., oxidized aromatic primary amino developing agent) and a color forming compound commonly referred to as a coupler. The dyes produced by coupling are indoaniline, azomethine, indamine or indophenol dyes, depending upon the chemical composition of the coupler and the developing agent. The subtractive process of color formation is ordinarily employed in multicolor photographic elements and the resulting image dyes are usually cyan, magenta and yellow dyes which are formed in or adjacent to silver halide layers sensitive to radiation complementary to the radiation absorbed by the image dye; i.e., silver halide emulsions sensitive to red, green and blue radiation.

The various ways recognized in the photographic art for improving the quality of such images produced in color photographic silver halide materials include the improvement of graininess, sharpness and color tonal rendition of such images by the use of compounds capable of providing a diffusible development inhibitor moiety as a function of silver halide development. The patent and technical literature is replete with references to compounds, generally referred to as DIR-compounds, which can be used for the above described purposes. Representative compounds are described in the following patents: U.S. Pat. Nos. 3,227,554; 3,701,783; 3,615,506; 3,617,291; 3,379,529; 3,620,746; 3,384,657; 3,733,201; 4,248,962 and 4,409,323.

It has been recognized that DIR-compounds, including those disclosed in the above representative patents, have in common the shortcoming that they comprise development inhibitor moieties which, after their release can diffuse out of the photographic material being processed, and accumulate in the processing solution. Such accumulation, commonly referred to as "seasoning", causes a loss of speed in color photographic materials subsequently processed in the solution. Measures taken to overcome this problem have required a more frequent exchange of processing solutions, as well as limiting the quantity and/or restricting the selection of inhibitor releasing compounds incorporated in the photographic material. Such measures are undesirable for reasons of economy and freedom of design.

Yet another approach to overcoming the seasoning problem is described in U.K. Pat. No. 2,099,167. This involves design of the development inhibitor molecule so that soon after contact with the processing solution, it is converted to a species which is inactive as a development inhibitor. While this patent describes this modification as applicable to all known development inhibitor classes, the preponderance of those described and exemplified are triazoles. For many applications, mercaptotetrazoles are a preferred class of inhibitors. However, those few mercaptotetrazole inhibitors which are shown in U.K. Pat. No. 2,099,167, as well as in subsequent applications such as EP Application No. 0,167,163 and Japanese Kokai No. 205150/83, are inadequate from the standpoint of interimage effect and sharpness. In addition, development inhibitors exemplified in the '167 patent are dependent upon the presence of a catalyst for their conversion into an inactive species in a reasonable period of time.

Accordingly, it is an object of this invention to provide compounds that release mercaptotetrazole development inhibitors which give high interimage effects and good sharpness, yet which are converted to an inactive species in the developer solution without the need for a catalyst.

SUMMARY OF THE INVENTION

We have found that these objects can be accomplished with a compound that releases, as a function of silver halide development, a development inhibitor having the structure:

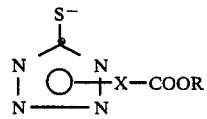

I wherein

X is alkylene of 1 to 3 carbon atoms;

R is alkyl of 1 to 4 carbon atoms; and the sum of the carbon atoms in X and R is 5 or less.

Thus, in one embodiment, this invention relates to DIR compounds which release development inhibitors having the above structure.

In another embodiment, this invention relates to photographic emulsions and elements containing such compounds.

In the above structural formula I, X is alkylene such as methylene, ethylene, n-propylene or isopropylene, and R is alkyl such as methyl, ethyl i-propyl, n-propyl, t-butyl sec-butyl, and n-butyl. Preferred are compounds where X is methylene and R is alkyl of 2 to 4 carbon atoms, especially n-alkyl.

The inhibitors of formula I can be released from any of the compounds from which inhibitors have been released in the art. Typically, the compound contains a carrier group from which the inhibitor is released either directly or from an intervening timing group which is first released from the carrier group.

Carrier groups useful in DIR-compounds of this invention include various known groups from which the development inhibitor moiety can be released by a variety of mechanisms. Representative carrier groups are described, for example, in U.S. Pat. No. 3,227,550 and Canadian Pat. No. 602,607 (release by chromogenic coupling); U.S. Pat. Nos. 3,443,939 and 3,443,940 (release by intramolecular ring closure); U.S. Pat. Nos. 3,628,952, 3,698,987, 3,725,062, 3,728,113, 3,844,785, 4,053,312, 4,055,428 and 4,076,529 (release after oxidation of carrier); U.S. Pat. No. 3,980,479, U.K. Pat. Nos. 1,464,104 and 1,464,105 and U.S. Pat. No. 4,199,355 (release unless carrier is oxidized); and U.S. Pat. No. 4,139,379 (release after reduction of carrier).

The timing group of the DIR-compounds of the invention can be any organic linking group which will serve to join the development inhibitor moiety to the carrier moiety and which, after its release from the carrier, will be cleaved from the development inhibitor fragment. Such timing groups are described, e.g., in U.S. Pat. Nos. 4,248,962; 4,409,323; and in U.S. patent application Ser. No. 890,674, filed July 30, 1986.

The development inhibitor moiety can be present in the DIR-compound as a preformed species or it can be present in a blocked form or as a precursor. For example, a preformed development inhibitor may be attached to either the carrier or the timing group via a non-inhibiting function, or the development inhibiting function may be blocked by being the point of attachment or blocked by a hydrolyzable group.

When the DIR-compound is an inhibitor releasing developing agent of the type disclosed, for example, in U.S. Pat. No. 3,379,529, the development inhibitor group is imagewise released as a result of silver halide development by the developing agent, optionally in the presence of an auxiliary developing agent.

When the DIR-compound is a hydroquinone compound of the type described, for example, in European Patent Application No. 0,167,168, the development inhibitor is imagewise released by a redox reaction in the presence of an oxidized developing agent.

When the DIR-compound is a coupler, the development inhibitor group is imagewise released by a coupling reaction between the coupler and oxidized color developing agent. The carrier moiety can be any coupler moiety employed in conventional color photographic couplers which yield either colored or colorless products on reaction with oxidized color developing agents. Both types of coupler moieties are well known to those skilled in the art.

Preferred couplers which form cyan dyes upon reaction with oxidized color developing agents are phenols and naphthols. Representative couplers are described in the following patents and publications: U.S. Pat. Nos. 2,772,162, 2,895,826, 3,002,836, 3,034,892, 2,474,293, 2,423,730, 2,367,531 and 3,041,236 and "Farbkupplerein Literaturubersicht," published in Agfa Mitteilungen, Band II, pp. 156–175 (1961).

Preferred couplers which form magenta dyes upon reaction with oxidized color developing agent are pyrazolones, pyrazolotriazoles, pyrazolobenzimidazoles and indazolones. Representative couplers are described in such patents and publications as U.S. Pat. Nos. 2,600,788, 2,369,489, 2,343,703, 2,311,082, 2,673,801, 3,152,896, 3,519,429, 3,061,432, 3,062,653, 3,725,067 and 2,908,573 and "Farbkupplereine Literaturubersicht," published in Agfa Mitteilungen, Band II, pp. 126–156 (1961).

Couplers which form yellow dyes upon reaction with oxidized color developing agent are acylacetanilides such as benzoylacetanilides and pivalylacetanilides. Representative couplers are described in the following patents and publications: U.S. Pat. Nos. 2,875,057, 2,407,210, 3,265,506, 2,298,443, 3,048,194 and 3,447,928 and "Farbkupplereine Literaturubersicht," published in Agfa Mitteilungen, Band II, pp. 112–126 (1961).

Also known are couplers which form black or neutral dyes upon reaction with oxidized color developing agent. Representative such couplers are resorcinols and m-aminophenols such as are described in U.S. Pat. Nos. 1,939,231, 2,181,944, 2,333,106, 4,126,461, German OLS No. 2,644,194 and German OLS No. 2,650,764.

It will be appreciated that, depending upon the particular carrier moiety, the particular developing agent and the type of processing, the development reaction product can be colored or colorless and diffusible or nondiffusible. Thus, it may or may not contribute to image density.

Representative compounds included within the scope of the invention include the following:

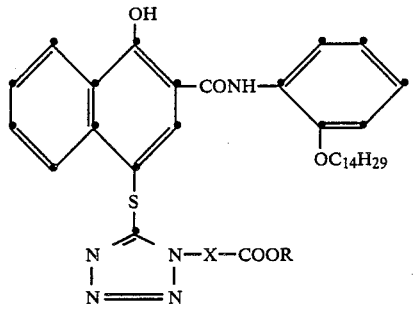

| Compound No. | X | R |
|---|---|---|
| 1 | $CH_2$ | $CH_3$ |
| 2 | $CH_2$ | $C_2H_5$ |
| 3 | $CH_2$ | $C_3H_7$ |
| 4 | $CH_2$ | $C_4H_9$ |
| 5 | $(CH_2)_2$ | $CH_3$ |
| 6 | $(CH_2)_3$ | $CH_3$ |
| 7 | $(CH_2)_3$ | $C_2H_5$ |

-continued
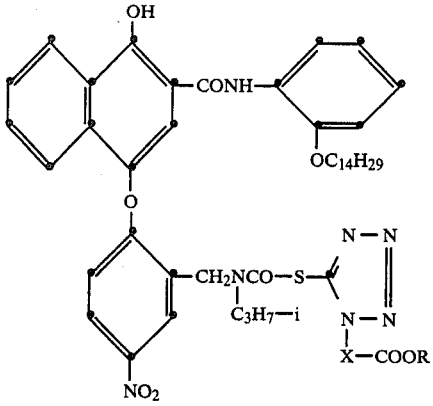
| Compound No. | X | R |
|---|---|---|
| 8 | $CH_2$ | $C_3H_7$ |
| 9 | $CH_2$ | $C_4H_9$ |
Compound 10
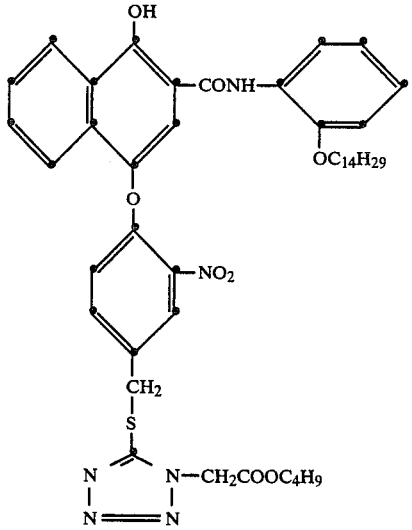
Compound 11
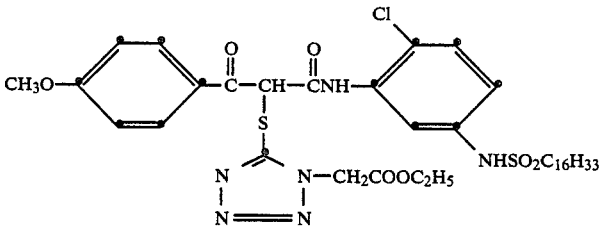
Compound 12
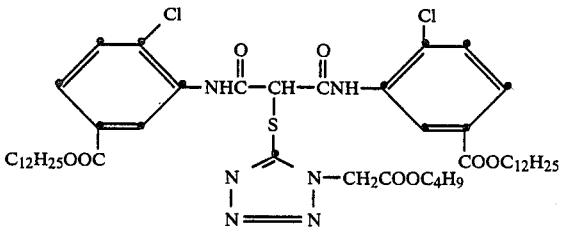

-continued
Compound 13
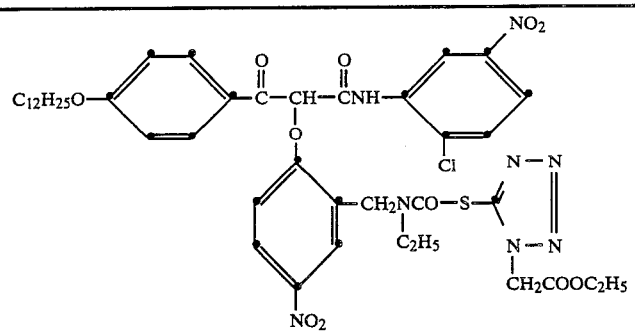
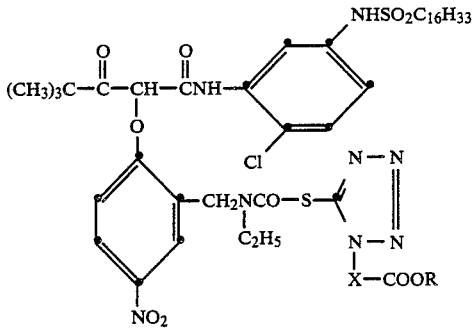
| Compound No. | X | R |
|---|---|---|
| 14 | $CH_2$ | $CH_3$ |
| 15 | $CH_2$ | $C_2H_5$ |
| 16 | $CH_2$ | $C_3H_7$ |
| 17 | $(CH_2)_2$ | $CH_3$ |
| 18 | $(CH_2)_2$ | $C_2H_5$ |
| 19 | $CH_2$ | $C_4H_9$ |
| 20 | $CH_2$ | $C_4H_9$—i |
| 21 | $(CH_2)_3$ | $CH_3$ |
Compound 22
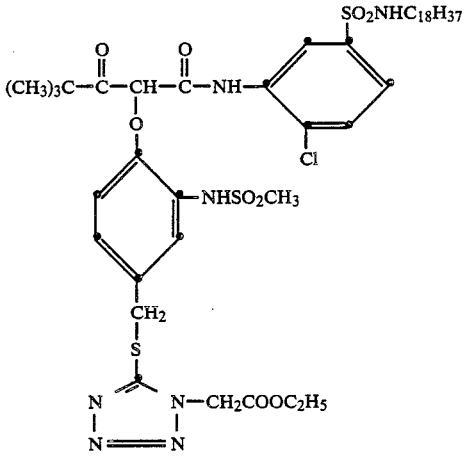
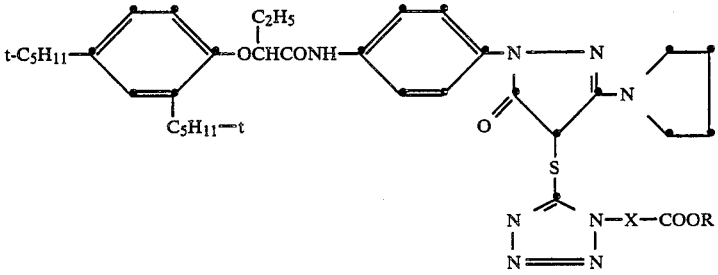
| Compound No. | X | R |
|---|---|---|
| 23 | $CH_2$ | $C_2H_5$ |

-continued

| | | |
|---|---|---|
| 24 | $CH_2$ | $C_3H_7$ |
| 25 | $CH_2$ | $C_4H_9$ |
| 26 | $CH_2$ | $C_4H_9$—i |
| 27 | $CH_2$ | $C_3H_7$—i |
| 28 | $(CH_2)_2$ | $CH_3$ |

The compounds employed in this invention can be prepared by synthetic procedures well known in the art. Generally, this involves first attaching the timing group, if one is to be a part of the compound, to the appropriate carrier moiety or a derivative thereof, followed by the attachment of the appropriate derivative of the inhibitor group to form the desired DIR-compound. Alternatively, the timing group can be attached to the carrier group after first combining the timing and inhibitor groups by an appropriate reaction. In the absence of a timing group, the inhibitor group is attached to the carrier moiety or a derivative thereof directly. The inhibitor fragment can be synthesized according to the scheme shown in J. Heterocyclic Chem., 15, 981 (1978). Illustrative syntheses are shown in the Examples which follow.

One advantage offered by compounds of the invention is that they provide inhibitor moieties having a combination of characteristics that afford improved color photographic, sensitometric and processing results. Such improved sensitometric results include enhanced image sharpness and color tonal rendition. Improved processing results include uncontaminated color developing solutions resulting from the absence therein of accumulated active development inhibitor molecules. We have found that the logarithm of the partition coefficient (Log P) is a good measure of the strength of the inhibitor and its mobility to provide interimage effects.

Log P is the logarithm of the partition coefficient of a species between a standard organic phase, usually octanol, and an aqueous phase, usually water. The color photographic element is a polyphasic system, and a photographic inhibitor released in such a system can partition between these various phases. Log P can serve as a measure of this partitioning, and can be correlated to desirable inhibitor properties such as inhibition strength and interimage effects. Inhibitor moieties of this invention with Log P values below 0.50 have been found to be too weak as inhibitors, although they may have useful interimage properties; while moieties with Log P values above 2.10, and especially above 2.25, have poor interimage properties although they have adequate inhibitor strength.

The Log P values used in this specification are, unless otherwise indicated, calculated using the additive fragment techniques of C. Hansch and A. Leo as described in "Substituent Constants for Correlation Analysis in Chemistry and Biology", Wiley, New York, 1979, using the computer program "MedChem", version 3.32, Medicinal Chemistry Project, Pomona College, Claremont, CA (1984). Where measured values of Log P are provided, such as in the examples infra, they are measured by the techniques cited in A. Leo, C. Hansch, and D. Elkins, Chem. Rev., 71, 525 (1971); see, for example, R. Livingston, "Physico Chemical Experiments", third edition, Macmillan, New York, 1957, pp. 217 ff. Briefly, the material to be evaluated is dissolved in octanol. An equal volume of water or aqueous buffer of appropriate pH is added and the vessel shaken vigorously for 2 min. The mixture is centrifuged, and aliquots taken from both layers. The aliquots are analyzed by hplc (liquid chromatography) by comparison to sample of known concentration, and Log P calculated from the log of the ratio of the amount in the octanol phase to the amount in the aqueous phase.

The DIR compounds can be used and incorporated in photographic elements in the way that DIR compounds have been used in the past. The photographic elements can be single color elements or multicolor elements. Multicolor elements contain dye image-forming units sensitive to each of the three primary regions of the visible spectrum. Each unit can be comprised of a single emulsion layer or of multiple emulsion layers sensitive to a given region of the spectrum. The layers of the element, including the layers of the image-forming units, can be arranged in various orders as known in the art. In an alternative format, the emulsions sensitive to each of the three primary regions of the spectrum can be disposed as a single segmented layer, e.g., as by the use of microvessels as described in Whitmore U.S. Pat. No. 4,362,806 issued Dec. 7, 1982.

In the following discussion of suitable materials for use in the emulsions and elements of this invention, reference will be made to *Research Disclosure*, December 1978, Item 17643, published by Industrial Opportunities Ltd., Homewell Havant, Hampshire, PO9 1EF, U.K., the disclosures of which are incorporated herein by reference. This publication will be identified hereafter by the term "Research Disclosure".

The silver halide emulsions employed in the elements of this invention can be either negative-working or positive-working. Suitable emulsions and their preparations are described in Research Disclosure Sections I and II and the publications cited therein. Suitable vehicles for the emulsion layers and other layers of elements of this invention are described in Research Disclosure Section IX and the publications cited therein.

In addition to the couplers generally described above, the elements of the invention can include additional couplers as described in Research Disclosure Section VII, paragraphs D, E, F and G and the publications cited therein. These couplers can be incorporated in the elements and emulsions as described in Research Disclosure Section VII, paragraph C and the publications cited therein.

The photographic elements of this invention or individual layers thereof, can contain brighteners (see Research Disclosure Section V), antifoggants and stabilizers (See Research Disclosure Section VI), antistain agents and image dye stabilizers (see Research Disclosure Section VII, paragraphs I and J), light absorbing and scattering materials (see Research Disclosure Section VIII), hardeners (see Research Disclosure Section XI), plasticizers and lubricants (See Research Disclosure Section XII), antistatic agents (see Research Disclosure Section XIII), matting agents (see Research Disclosure Section XVI) and development modifiers (see Research Disclosure Section XXI).

The photographic elements can be coated on a variety of supports as described in Research Disclosure Section XVII and the references described therein.

Photographic elements can be exposed to actinic radiation, typically in the visible region of the spectrum, to form a latent image as described in Research Disclosure Section XVIII and then processed to form a visible dye image as described in Research Disclosure Section XIX. Processing to form a visible dye image includes the step of contacting the element with a color developing agent to reduce developable silver halide and oxidize the color developing agent. Oxidized color developing agent in turn reacts with the coupler to yield a dye.

Preferred color developing agents useful in the invention are p-phenylene diamines. Especially preferred are 4-amino-N,N-diethyl, aniline hydrochloride, 4-amino-3-methyl-N,N-diethylaniline hydrochloride, 4-amino-3-methyl-N-ethyl-N-β-(methanesulfonamido)ethylaniline sulfate hydrate, 4-amino-3-methyl-N-ethyl-N-β-hydroxyethylaniline sulfate, 4-amino-3-β-(methanesulfonamido)ethyl-N,N-diethylaniline hydrochloride and 4-amino-N-ethyl-N-(2-methoxyethyl)-m-toluidine di-p-toluenesulfonic acid.

With negative working silver halide, the processing step described above gives a negative image. To obtain a positive (or reversal) image, this step can be preceded by development with a non-chromogenic developing agent to develop exposed silver halide, but not form dye, and then uniformly fogging the element to render unexposed silver halide developable. Alternatively, a direct positive emulsion can be employed to obtain a positive image.

Development is followed by the conventional steps of bleaching, fixing, or bleach-fixing, to remove silver and silver halide, washing and drying.

The following examples are included for a further understanding of this invention.

Compounds of this invention may be prepared by first synthesizing the inhibitor fragment according to the following scheme (see J. Heterocyclic Chem., 15, 981 (1978) and then attaching it to the carrier or to the timing group as defined hereinbefore by well-known methods.

GENERAL SYNTHESIS

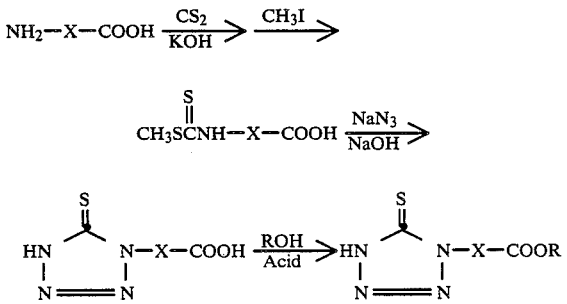

SYNTHESIS EXAMPLE I

Preparation of 1-n-Propoxycarbonylmethyl-2-tetrazoline-5-thione

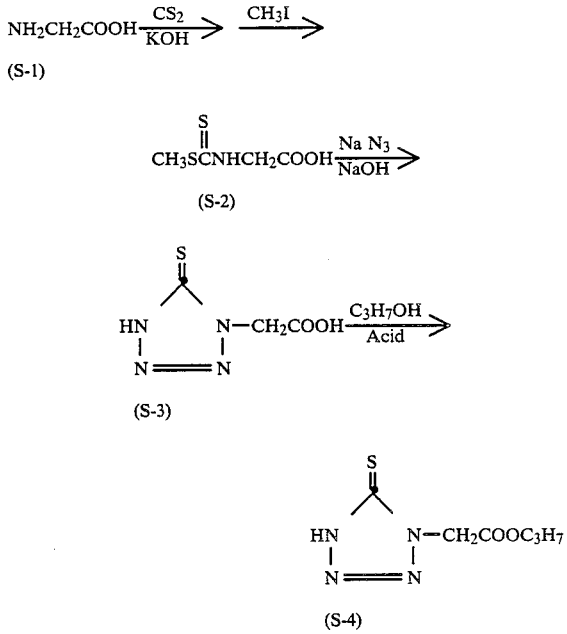

To a stirred solution of 30 g (0.4 mol) glycine (S-1) and 45 g (0.8 mol) potassium hydroxide in a 100 ml water is added over a period of 1.5 hour 24.4 ml (0.4 mol) carbon disulfide while heating the mixture on a steambath. After an additional 6 hours, heat is removed and 100 ml ethanol is added, followed by the addition over a period of 1 hour of 24.8 ml (0.4 mol) methyl iodide. Upon standing at room temperature overnight, the mixture is concentrated and acidified with sulfuric acid, and the resulting solid is removed by filtration and washed briefly with cold water. The filtrate is extracted with ethyl acetate and concentrated to yield 32.4 g crystalline acid, (S-2), (m.p. 110°-111° C. on further recrystallization from toluene/ligroin). A solution of this acid (196 mmol), 7.8 g (196 mmol) sodium hydroxide and 14.3 g (220 mmol) sodium azide in 400 ml water is heated for 3 hours on a steambath, cooled, and acidified to pH 2 with hydrochloric acid. An extractive workup yields 7 g of 1-carboxymethyl-2-tetrazoline-5-thione (S-3). More product is obtained upon repeated extraction.

This acid is next esterified by heating for 1.5 hour on a steambath 20 g (125 mmol) in 400 ml n-propanol and 3 ml concentrated sulfuric acid. Concentration and extractive workup give a crude product, m.p. 62°-64° C., which on recrystallization from toluene/hexane yields 11.3 g of the thione S-4, m.p. 62°-64° C., whose mass and nmr spectra are consistent with those of the desired ester.

Elemental analysis—Calculated: C, 35.6; H, H, 5.0; N, 27.7. Found: C, 36.0; H, 4.9; N, 27.2.

SYNTHESIS EXAMPLE II

Preparation of Compound 24

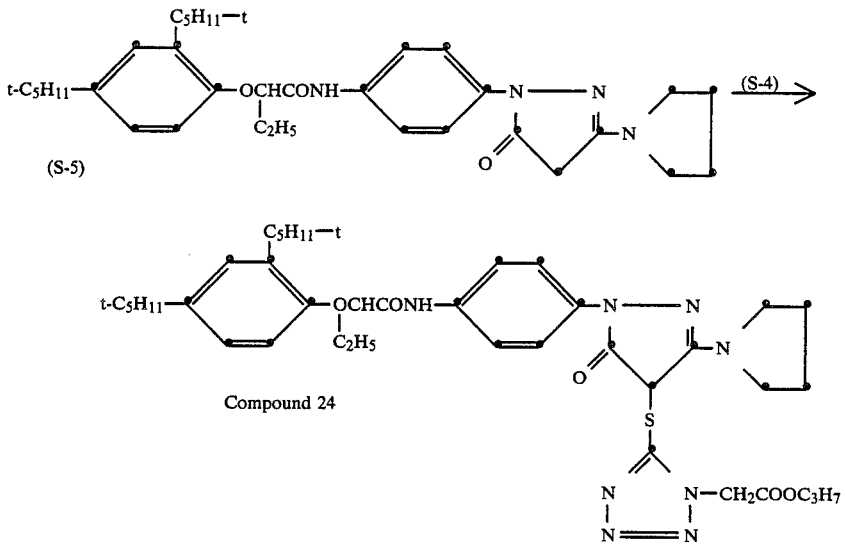

Compound 24

To a stirred solution of 10.92 g (20 mmol) Coupler (S-5) and 4.04 g (20 mmol) thione (S-4) in 150 ml dimethylformamide chilled to 5°-10° C. is added a solution of 3.2 g (20 mmol) bromine in 10 ml dimethylformamide. After 1 hour, the mixture is poured into ice water, and following filtration, washing and drying, a yield of 11.4 g, m.p. 133°-141° C., is obtained. An acetonitrile solution is treated with Norit carbon, filtered and water added to precipitate purified product, yielding after drying 8.3 g Compound 25, m.p. 124°-125° C.

Elemental analysis—Calculated: C, 62.7; H, 7.3; N, 15.0; Found: C, 62.5; H, 7.2; N, 15.0.

SYNTHESIS EXAMPLE III

Preparation of Compound 16

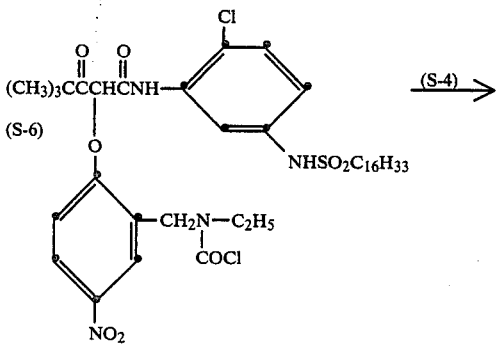

-continued

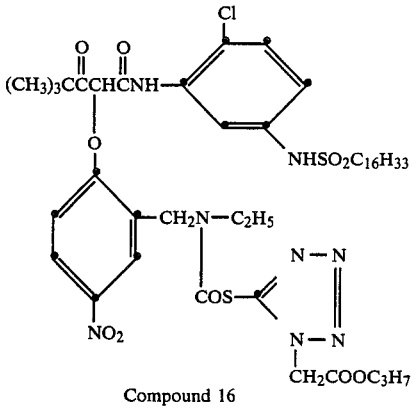

Compound 16

Procedures described in U.S. Pat. No. 4,248,962 (Columns 26 and 28) are used to prepare intermediate (S-6), a yellow dye-forming coupler with an attached timing group terminating in a carbamoyl chloride moiety. A solution of 24.4 g (30 mmol) of S-6 and 6.06 g (30 mmol) of (S-4) in 250 ml anhydrous pyridine is stirred for 16 hours under a nitrogen atmosphere. The reaction mixture is next poured into an ice/ethyl acetate mixture and carefully acidified with concentrated hydrochloric acid to pH 4 with vigorous stirring, then shaken with a brine/ethyl acetate mixture. The organic phase is separated, dried over magnesium sulfate, concentrated and purified by silica gel chromatography and a 72-hour trituration of the resulting solid with hexane. Pressing this solid on a porous plate and drying yield 7.9 g of Compound 16, m.p. 90°-93° C.

Elemental analysis—Calculated: C, 55.2; H, 6.9; Cl, 3.6; N, 11.4; S, 6.5. Found: C, 55.2; H, 6.6; Cl, 3.5; N, 11.3; S, 6.4.

SYNTHESIS EXAMPLE IV

Preparation of Compound 10

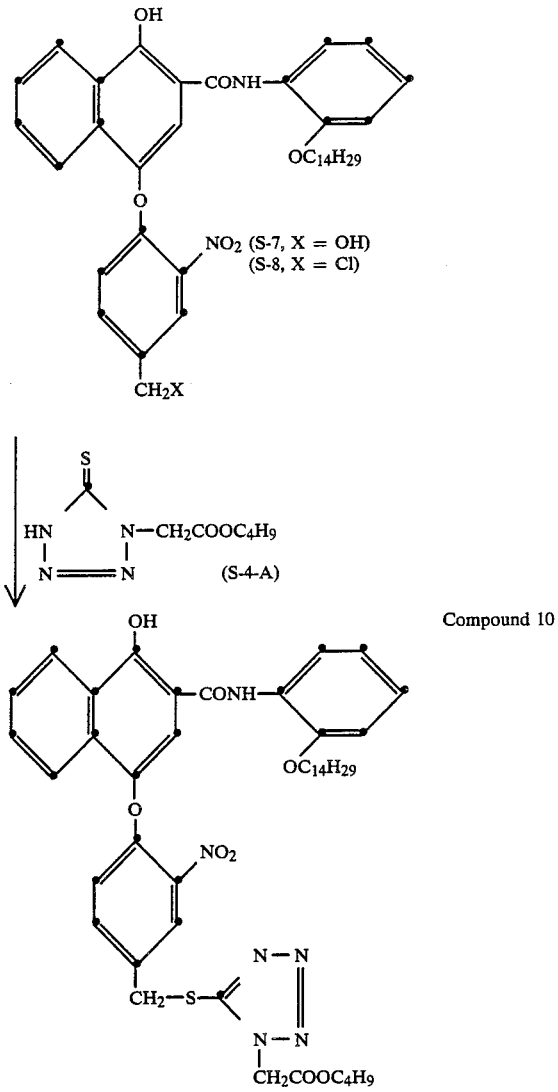

Compound 10

A solution of 3.21 (5 mmol) of intermediate (S-7, X=OH) and 2 ml thionyl chloride in 35 ml methylene chloride is stirred for 18 hours at room temperature, then concentrated, redissolved in heptane/methylene chloride, and reconcentrated. The resulting solid (S-8, X=Cl) is dissolved in 20 ml methylene chloride and stirred for 24 hours with a solution of 1.08 g (5 mmol) of ester (S-4-A), 0.42 g (5 mmol) sodium bicarbonate, and 0.1 g tetrabutylammonium bromide in 20 ml water. The organic phase is separated, dried, concentrated, and chromatographed on silica gel with methylene chloride. An impure fraction (0.75 g) and a purer fraction (1.51 g) are isolated after treatment with n-butanol/hexane and subsequent drying. The latter is identified as the desired Compound 10. Elemental analysis—Calculated: C, 64.3; H, 6.7; N, 10.0; S, 3.8. Found: C, 64.5; H, 7.0; N, 10.0; S, 3.3. Trace amounts of free inhibitor are removed by washing a diethyl ether solution with aqueous sodium bicarbonate solution, separating the organic phase, drying, concentrating, treating with n-butanol, and drying in vacuum for 24 hours.

EXAMPLES

To demonstrate interimage effects and image sharpness with compounds of this invention, a series of color photographic materials was prepared in which a green-sensitive "causer" layer provided an image from a magenta, yellow or cyan dye-forming coupler, and an underlying red-sensitive "receiver" layer provided a differently colored image derived from a yellow or magenta dye-forming coupler. In a first example of the series, the material had the following schematic layer structure (coating coverages are parenthetically given in mg/m$^2$):

| |
|---|
| Overcoat layer of Gelatin (4800), and Gelatin hardener, 1.75% of total gelatin |
| Causer Layer of Green-sensitive AgBrI (1600), Gelatin (2400), Magenta dye-forming coupler M-1 (915) and DIR-coupler (see Tables) |
| Interlayer of a scavenger for oxidized developer, 2,5-Didodecylhydroquinone (115) and Gelatin (620) |
| Receiver Layer of Red-sensitive AgBrI (1600), Gelatin (2400), and Yellow dye-forming coupler Y-1 (1300) |
| Film Support of Cellulose acetate butyrate coated with antihalation gray silver (324), Gelatin (2452) and Antistain agent (15) |

The hardener was bis(vinylsulfonylmethyl)ether and the silver bromoiodide (coating weight is that of silver) was a 6.4% iodide emulsion of 0.5 μm average grain size chemically sensitized with sulfur and gold. The yellow dye-forming coupler was dispersed in half its weight of dibutyl phthalate, the magenta coupler in half its weight of tricresyl phosphate, and each DIR-coupler in twice its weight of diethyl lauramide.

Magenta dye-forming coupler (M-1)

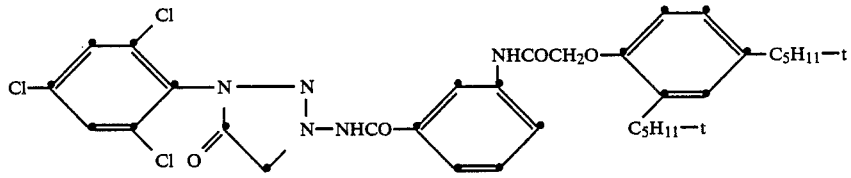

Yellow dye-forming coupler (Y-1)

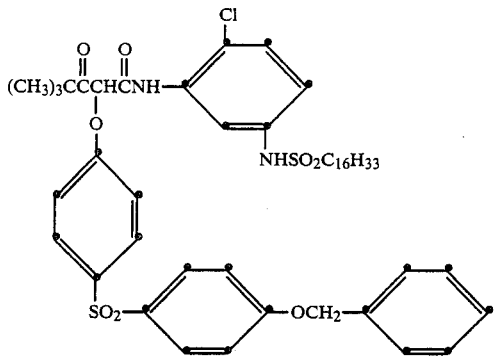

The materials were processed at 38° C. as follows:

| Step | Time |
|---|---|
| Color Developer | 2-¾' |
| Stop (5% Acetic Acid) | 2' |
| Wash | 2' |
| Bleach ($Fe(CN)_6$) | 2' |
| Wash | 2' |
| Fix | 2' |
| Wash | 2' |
| Color developer composition | g/L |
| $K_2SO_3$ | 2.0 |
| 4-Amino-3-methyl-N—ethyl-N—β-hydroxyethylaniline sulfate | 3.35 |
| $K_2CO_3$ | 30.0 |
| KBr | 1.25 |
| KI | 0.0006 |
| $H_2O$ to 1L, Adjusted to pH 10 | |

In order to evaluate interimage effect, the element was exposed through a graduated density test object and a minus blue (WR-R) filter and then processed as described above. Sensitometric curves were generated from the exposed and processed elements from which contrast (γ) in each of the causer and receiver layer was measured. A comparison of the ratio of $\gamma_c/\gamma_r$ for an element containing a DIR compound with one from which such compound is omitted gives an indication of where in the element the inhibitor has its predominant effect. Materials in which $\gamma_c/\gamma_r$ increases upon addition of the inhibitor show that the inhibitor is acting more in the receiver than is the cause and thus shows good interimage effects.

In order to evaluate sharpness, the element was exposed through a Wratten 99 (green) filter and processed as described above.

From the exposed and processed elements CMT-35 accutance was measured at a contrast (γ) of 1 by the techniques described and discussed in "An Improved Objective Method for Rating Picture Sharpness: CMT Acutance," by R. G. Gendron, Journal of the SMPTE, 82, 1009-12 (December, 1973). The higher the CMT accutance number, the sharper the image.

EXAMPLE 1

In the element schematically shown above, the following DIR couplers were used at various coverages in the range 20 to 200 mg/m². The $\gamma_c/\gamma_r$ reported is taken from the straight line portion of the resulting plot. CMT Accutance is measured on a sample that yields a γ of approximately 1. The results obtained are shown below.

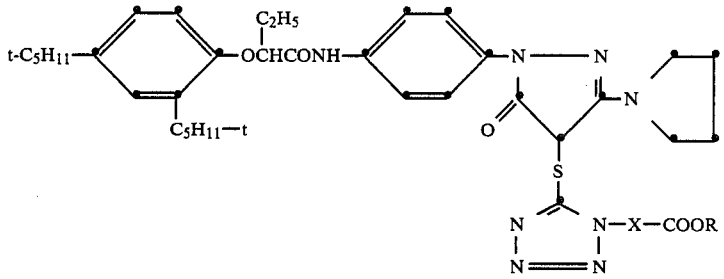

TABLE 1

| Compound | $\gamma_c/\gamma_R$ | CMT Accutance |
|---|---|---|
| Control (no DIR Coupler) | 1.42 | 90.6 |
| Comparison (Compound T-1 X—COO— R = Phenyl) | 0.55 | 91.8 |
| Invention (Compound 27, X = $CH_2$, R = $C_3H_7$—i) | 0.86 | 95.2 |

From these results it can be seen that the compound of the invention provides significantly higher interimage and accutance than the comparison compound, which has a medium interimage effect.

EXAMPLE 2

The procedure described in Example 1 was repeated with samples wherein the green-sensitive "causer" layer contained the magenta dye-forming coupler M-2:

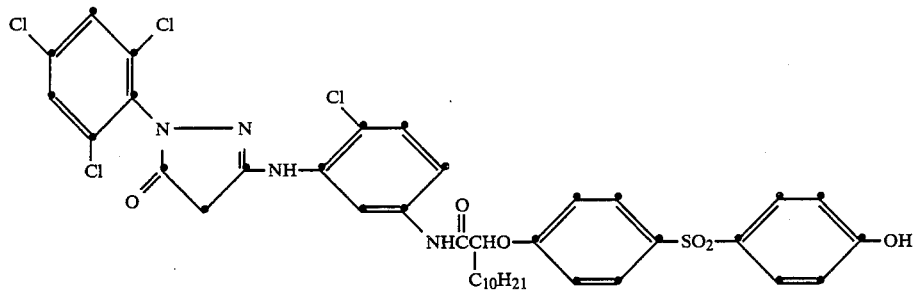

and the red-sensitive "receiver" layer contained the yellow dye-forming coupler Y-1 from Example 1. As shown in Table 2, below, the results were essentially the same.

TABLE 2

| Compound | $\gamma_c/\gamma_R$ | CMT Accutance |
|---|---|---|
| Control (no DIR Coupler) | 1.67 | 90.9 |
| Comparison (Compound T-1) | 0.74 | 92.4 |
| Invention (Compound 27) | 1.01 | 95.4 |

EXAMPLE 3

A format similar to that shown in Example 1 was employed wherein the green-sensitive "causer" layer provided a yellow image and the underlying "receiving" layer provided a magenta image. The results obtained are shown in Table 3.

The image couplers were those used in Example 1. The DIR Couplers used had the structure

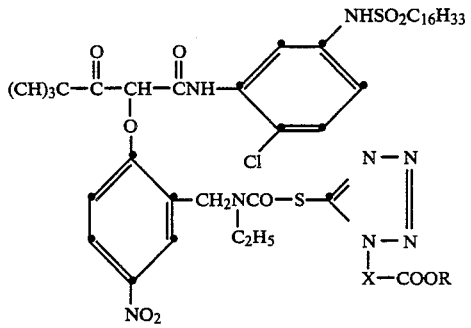

TABLE 3

| Compound | $\gamma_c/\gamma_r$ | CMT Accutance |
|---|---|---|
| Control (No DIR Coupler) | 1.54 | 90.0 |
| Comparison (Compound T-2 X—COO—R = Phenyl) | 2.38 | 92.2 (@ $\gamma$ = 0.9) |
| Invention (Compound 16 X = ($CH_2$, R = $C_3H_7$) | 3.84 | 94.9 (@ $\gamma$ = 0.9) |

These results show that the invention compound give a significantly higher interimage than does the comparison compound.

EXAMPLE 4

A format similar to that shown in Example 1 was employed wherein the green-sensitive "causer" layer provided a cyan image and the underlying "receiver" layer provided a yellow image.

The cyan dye-forming coupler (C-1) contained in the causer layer had the following structure:

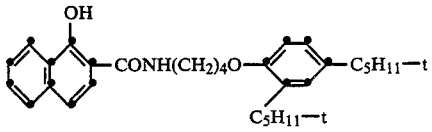

C-1

The yellow dye-forming coupler contained in the receiver layer was coupler Y-1 from Example 1.

The DIR couplers had the structure

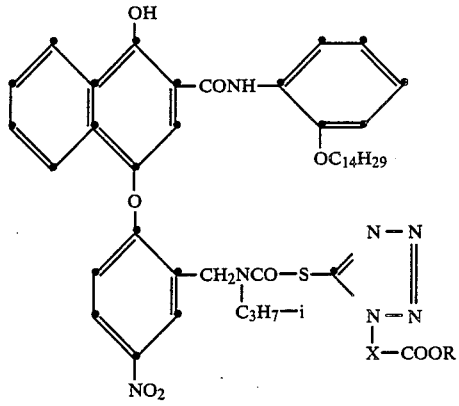

TABLE 4

| Compound | $\gamma_c/\gamma_R$ | AMT Accutance |
|---|---|---|
| Control (no DIR coupler) | 1.64 | 92.3 |
| Comparison (Compound T-3 X & R = Phenyl) | 0.85 | 90.5 (@ $\gamma$ = 1.4) |
| Invention (Compound 8 X = $CH_2$, R = $C_3H_7$) | 1.79 | 93.8 (@ $\gamma$ = 1.4) |

The results are essentially the same as obtained in earlier comparisons.

EXAMPLE 6

Seasoning

This example illustrates that the inhibitors of the invention are essentially non-seasoning compared to the ethyl mercaptotetrazole (EMT), reference compound A, and comparison inhibitor W, as shown in Table 6. For this evaluation, inhibitor compounds were stirred into a developer solution and, after the time indicated, exposed strips of a single-layer photographic coating were developed in the so-called "seasoned" solution. The EMT was not inactivated and therefore caused the most speed loss, while compounds of this invention were rendered inactive as development inhibitors even in the absence of a catalyst. Effective deactivation of the phenyl ester of 5-carboxybenzotriazole (inhibitor W) required the presence of a catalyst (hydroxylamine sulfate in Developer B).

INHIBITORS USED IN EXAMPLE 6

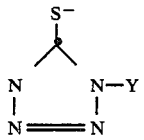

| INHIBITOR | Y |
|---|---|
| A (comparison) | $-C_2H_5$ |
| 1 (Invention) | $-CH_2COOCH_3$ |
| 2 (Invention) | $-CH_2COOC_2H_5$ |
| 3 (Invention) | $-(CH_2)_2COOCH_3$ |
| 4 (Invention) | $-(CH_2)_2COOC_2H_5$ |

INHIBITOR W (Comparison)

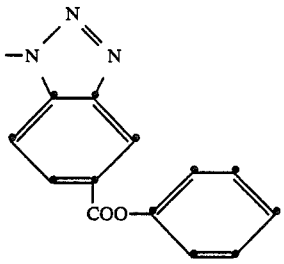

TABLE 6

| | | | Seasoning Effects | | | | | | |
|---|---|---|---|---|---|---|---|---|---|
| | | | Speed Loss (logE) at time (min.) | | | | | | |
| INH | mg/L | Dev. | 7 | 15 | 30 | 60 | 120 | 180 | 300 |
| A | 30 | A | 0.60 | → | → | → | → | → | 0.60 |
| A | 4 | A | 0.15 | → | → | → | → | → | 0.15 |
| A | 4 | B | 0.11 | → | → | → | → | → | 0.11 |
| 1 | 30 | A | 0.30 | 0.24 | 0.15 | 0 | → | → | 0 |
| 1 | 4 | A | 0 | → | → | → | → | → | 0 |
| 2 | 30 | A | 0.38 | 0.21 | 0.09 | 0 | → | → | 0 |
| 2 | 4 | A | 0 | → | → | → | → | → | 0 |
| 3 | 30 | A | 0.21 | 0.15 | 0.09 | 0 | → | → | 0 |
| 3 | 30 | B | 0.36 | 0.27 | 0.23 | 0.23 | 0 | → | 0 |
| 3 | 6 | A | 0.03 | 0 | → | → | → | → | 0 |
| 3 | 6 | B | 0 | → | → | → | → | → | 0 |
| 4 | 30 | A | 0.75 | 0.75 | 0.66 | 0.63 | 0.42 | 0.33 | 0.12 |
| 4 | 4 | A | 0.06 | 0.05 | 0.04 | 0 | → | → | 0 |
| W | 10 | A | 0.68 | 0.57 | 0.45 | 0.30 | 0.08 | 0.03 | 0 |
| W | 10 | B | 0.06 | 0.04 | 0 | → | → | → | 0 |

Color developer A is the same as used in examples above;
Color developer B has 3.0 g/L hydroxylamine sulfate added.

The invention has been described in detail with particular reference to preferred embodiments thereof, but it will be understood that variations and modifications can be effected within the spirit and scope of the invention.

What is claimed is:

1. A photographic element comprising a support bearing a silver halide emulsion layer and a photographic compound which, as a function of silver halide development, provides a development inhibitor having the structure:

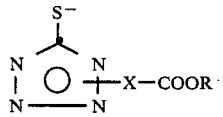

wherein

X is alkylene of 1 to 3 carbon atoms;

R is alkyl of 1 to 4 carbon atoms; and the sum of the carbon atoms in X and R is 5 or less.

2. A photographic element of claim 1 wherein:

X is methylene and

R is alkyl of 2 to 4 carbon atoms.

3. A photographic element of claim 1 wherein the development inhibitor has the structure:

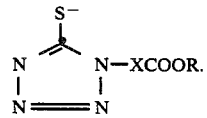

4. A photographic element of claim 1 wherein the development inhibitor has a log P of between about 0.50 and 2.25.

5. A photographic element of claim 1 wherein the development inhibitor is joined directly to the coupling position of a photographic coupler.

6. A photographic element of claim 1 wherein the development inhibitor is joined to the coupling position of a photographic coupler through a timing group.

7. A photographic element of claim 6 wherein the coupler is a yellow dye-forming coupler.

8. A photographic element of claim 6 wherein the coupler is a cyan dye-forming coupler.

9. A photographic element of one of claims 7 and 8 wherein the development inhibitor has the structure:

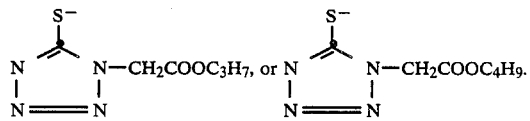

10. A photographic element of claim 9 wherein the coupler is contained in one or more layers of a multilayer, multicolor photographic element.

11. A process of forming a color photographic image which comprises developing an exposed silver halide photographic element, which yields a dye image, in the presence of a development inhibitor having the structure

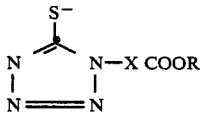

where X is alkylene of 1 to 3 carbon atoms, R is alkyl of 1 to 4 carbon atoms, and the sum of the carbon atoms in X and R is 5 or less.

* * * * *